US009413091B2

(12) United States Patent
Wu et al.

(10) Patent No.: US 9,413,091 B2
(45) Date of Patent: Aug. 9, 2016

(54) ELECTRICAL CONNECTOR ASSEMBLY WITH IMPROVED CONTACT ARRANGEMENT

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/819,710

(22) Filed: Aug. 6, 2015

(65) Prior Publication Data

US 2016/0043519 A1 Feb. 11, 2016

(30) Foreign Application Priority Data

Aug. 6, 2014 (CN) ..... 2014 1 0382943

(51) Int. Cl.
*H01R 4/66* (2006.01)
*H01R 13/02* (2006.01)
*H01R 24/60* (2011.01)

(52) U.S. Cl.
CPC ..... *H01R 13/02* (2013.01); *H01R 24/60* (2013.01)

(58) Field of Classification Search
CPC ..... H01R 13/02; H01R 13/65802; H01R 13/6658; H01R 24/60
USPC ..... 439/92
See application file for complete search history.

(56) References Cited

U.S. PATENT DOCUMENTS

| | | | | |
|---|---|---|---|---|
| 7,559,805 | B1 * | 7/2009 | Yi | H01R 13/6658 439/660 |
| 8,011,968 | B2 * | 9/2011 | Lai | H01R 13/65802 439/660 |
| 2011/0028046 | A1 * | 2/2011 | Wang | H01R 24/60 439/660 |
| 2014/0308848 | A1 | 10/2014 | Shi et al. | |

* cited by examiner

*Primary Examiner* — Jean F Duverne
(74) *Attorney, Agent, or Firm* — Ming Chieh Chang; Wei Te Chung

(57) ABSTRACT

An electrical connector assembly includes an insulative housing and a set of contacts retained in the insulative housing, the contacts including a power contact, a negative contact, a positive contact, a first grounding contact, a power provided by device (DPWR) contact, and a second grounding contact, a contacting portion of each of the set of second contacts being spaced a respective contacting distance from a front end surface of the insulative housing. A contacting distance management makes the mating connector sequentially connect with the power contact and the grounding contact, the negative contact and the positive contact, all the first contacts, the DPWR contact, the grounding contacts. Such contact arrangement is to prevent a false recognition of the two power contacts by power system circuits.

7 Claims, 8 Drawing Sheets

ELECTRICAL CONNECTOR ASSEMBLY WITH IMPROVED CONTACT ARRANGEMENT

BACKGROUND OF THE INVENTION

1. Field of the Invention

The present invention relates to an electrical connector assembly, and more particularly to an electrical connector assembly having improved arrangement of contacts.

2. Description of Related Art

Universal Serial BUS (USB) is a widely used input/output interface adapted for many electronic devices, such as personal computers and related peripherals. Nowadays, USB-IF has published several specification editions for USB, and transmitting rate of USB has become higher and higher. As electronic industry develops, higher transmitting rate of USB based connection accessory is needed.

A USB 3.0 specification over USB 2.0 has been adopted for transmitting high speed data. A USB 3.0 connector has five additional contacts for high speed signal transmission. A USB 3.0 connector of Powered-B type has two lateral contacts, one of the two lateral contacts being a power contact, and the other one being a ground contact. The power contact can supply power for peripheral equipment connected with the USB 3.0 connector of Powered-B type, without the need of additional power supply. For the present, the USB 3.0 POWER-B has two power supplies, +5V and +12V. The +5V power supply supplies power source for the USB 2.0 and USB 3.0, and the +12V power supply supplies power source for the peripheral electronic devices. When the mating connector is connected to the USB 3.0 connector, the mating order of the contacts is as follows: the +5V contact, the +12V contact, the USB 2.0 contact, the USB 3.0 contact. In this mating order, since the +12V power supply is immediately following the +5V power supply, the recognition thereof is made difficult, i.e., it is prone to error by a power system circuit and increases the difficulty in power system circuit designs.

Hence, an electrical connector assembly with improved arrangement of contacts is desired to overcome the above problems.

BRIEF SUMMARY OF THE INVENTION

According to one aspect of the present invention, an electrical connector assembly comprises:

an insulative housing defining a receiving space;

a plurality of contacts retained in the insulative housing, the contacts comprising a set of first contacts and a set of second contacts, each of the first and second contacts having a contacting portion and a tail portion, the second contacts received in the receiving space;

a cable electrically connected with the plurality of contacts; and a shielding member enclosing on the insulative housing to form a cavity, the cavity receiving the first contacts; wherein the second contacts are for transmitting high speed signal and comprise a power contact, a negative contact for transmitting negative signal, a positive contact for transmitting positive signal, a first grounding contact return to the power connect, a power provided by device (DPWR) contact, and a second grounding contact return to the DPWR contact;

the contacting portion of each of the set of second contacts is spaced a respective contacting distance from a front end surface of the insulative housing; and the contacting distances of the power contact and the grounding contact are equal to each other and the shortest, the contacting distances of the negative contact and the positive contact are equal to each other and longer than the contacting distance of the power contact, the contacting distances of the first contacts are equal to each other and longer than the contacting distance of the positive contact, and the contacting distances of the DPWR contact and the second grounding contact are equal to each other and longer than the contacting distance of the first contact.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
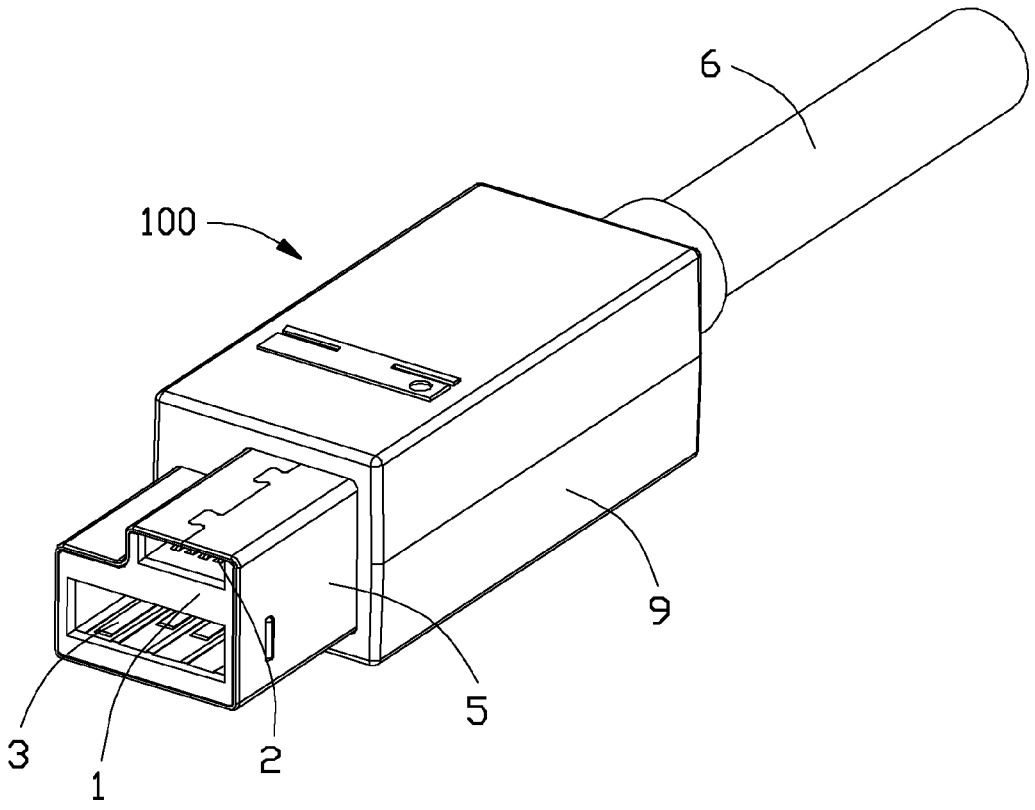
FIG. 1 is a perspective assembled view of an electrical connector assembly according to the present invention.

In the following description, numerous specific details are set forth to provide a thorough understanding of the present invention. However, it will be obvious to those skilled in the art that the present invention may be practiced without such specific details.

Referring to FIGS. 1-4, an electrical connector assembly 100 according to a preferred embodiment of the present invention includes an insulative housing 1, a plurality of first and second contacts 2, 3 retained in the insulative housing 1, a spacer 4 assembled to the insulative housing 1 for retaining the first and second contacts 2, 3, a shielding member 5 enclosing on the insulative housing 1, a cable 6 electrically connected with the first and second contacts 2, 3, an inner insulator 7 molded on an electrical connection between the cable 6 and the first and second contacts 2, 3, a front cover 8, and a back cover 9 over-molded on the cable 6.

Figure 4:
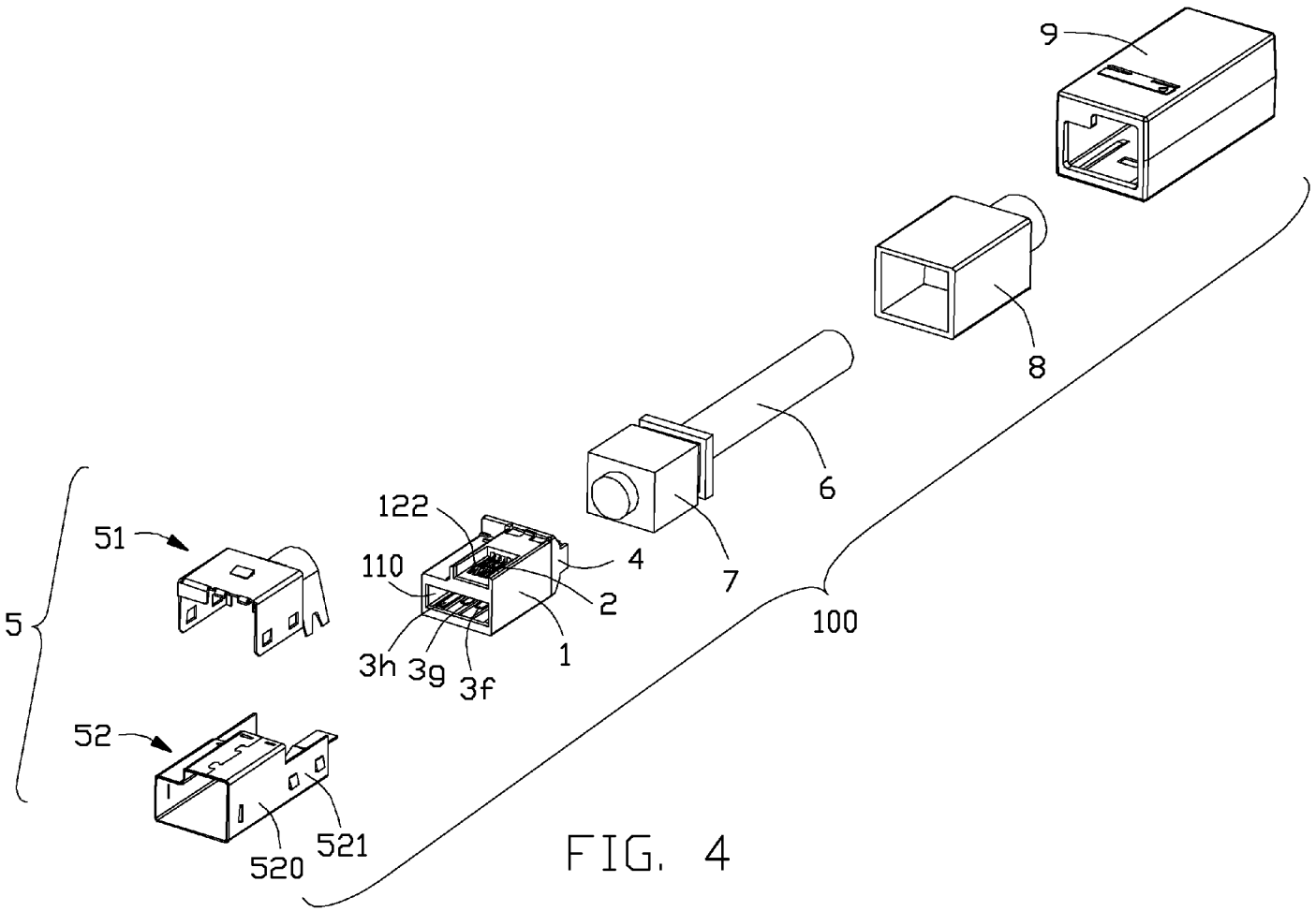
FIG. 4 is a further exploded view of the electrical connector assembly shown in FIG. 3.
Figure 5:
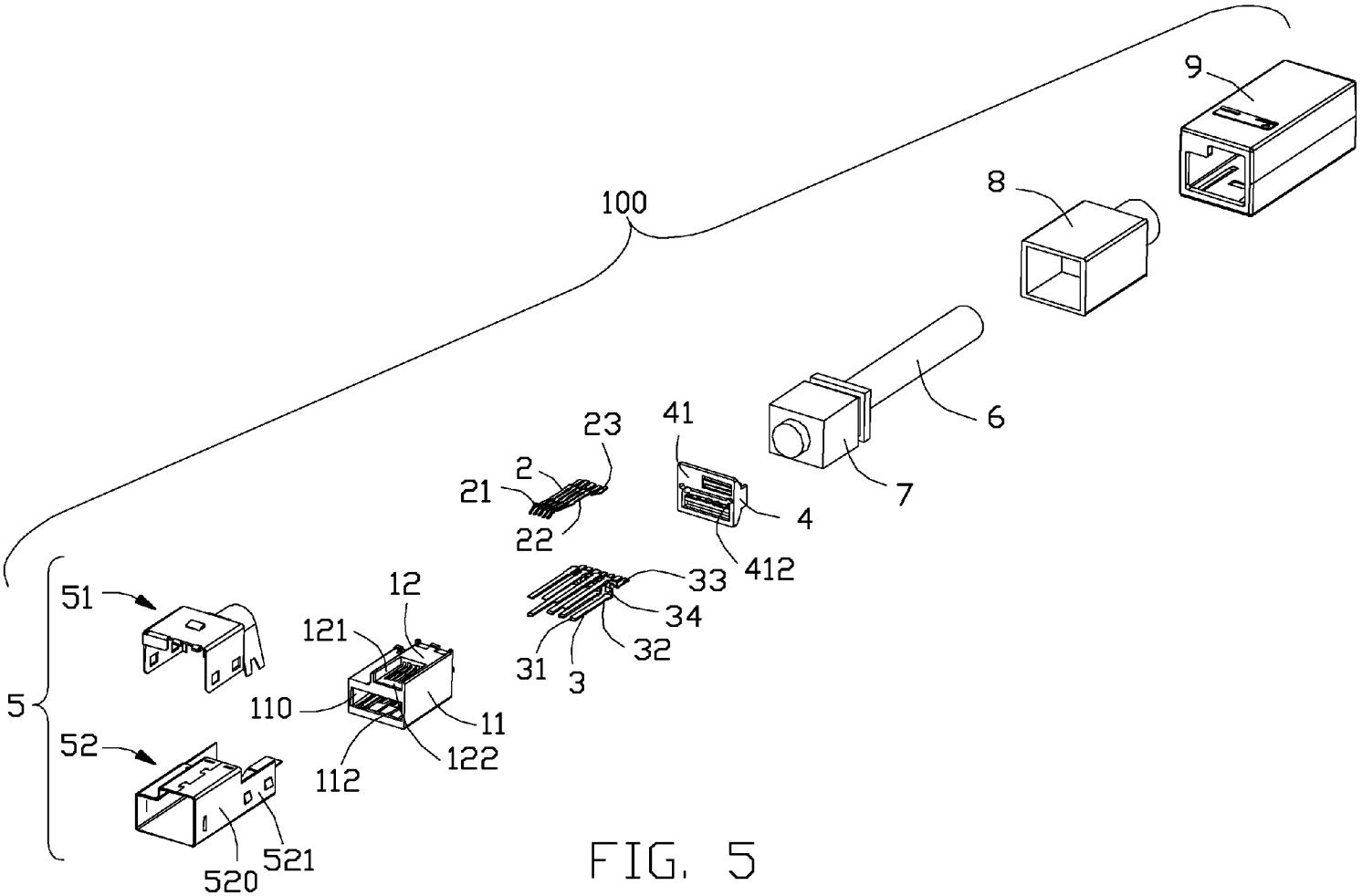
FIG. 5 is a further exploded view of the electrical connector assembly shown in FIG. 4.
Figure 6:
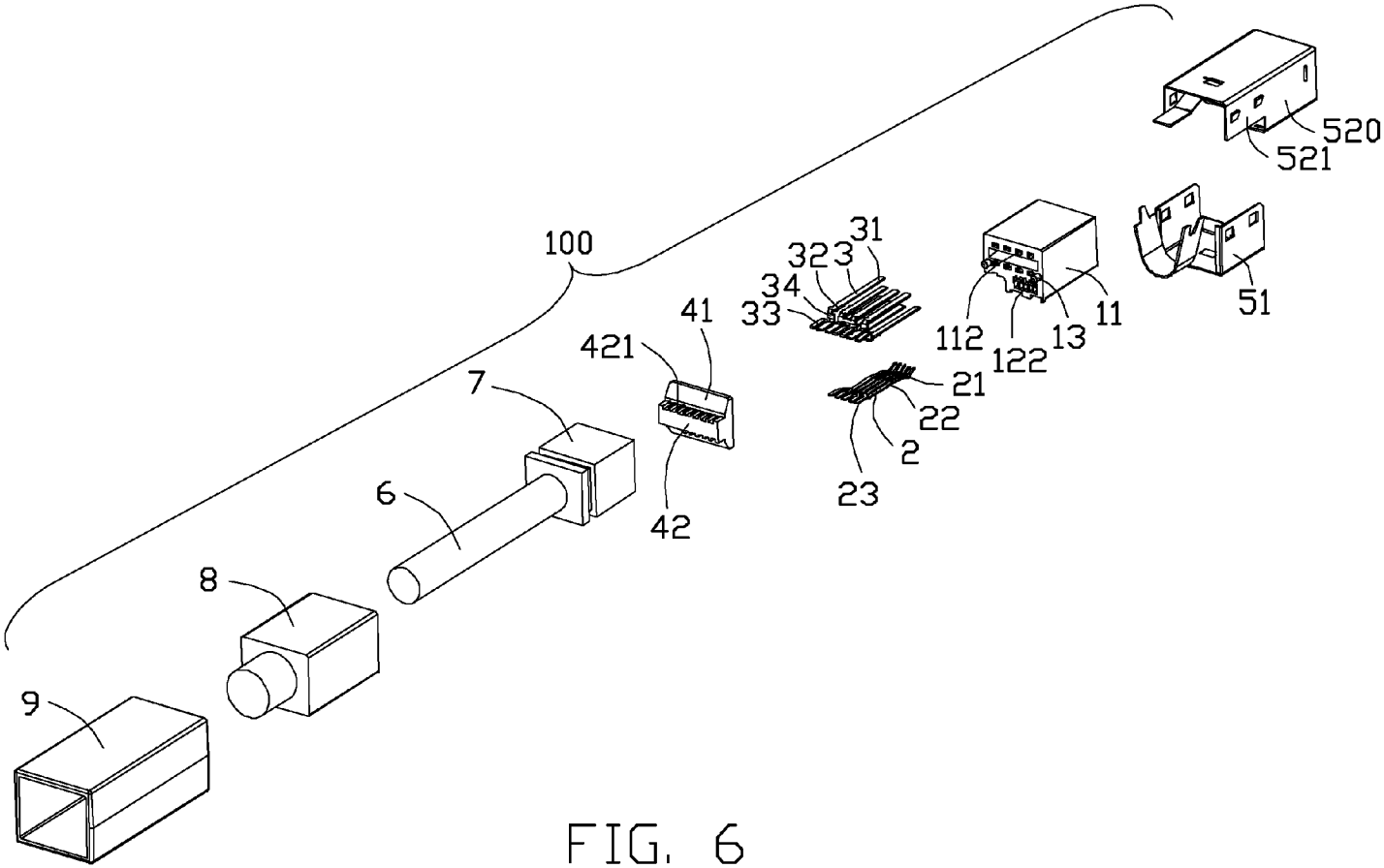
FIG. 6 is exploded view of the electrical connector assembly shown in FIG. 5 from a different perspective.

Referring to FIGS. 4-6, the insulative housing 1 includes a main portion 11, an extension portion 12 extending upwards from a top surface of the main portion 11, and a pair of positioning posts 13 extending rearwards from a back end surface of the main portion 11. A receiving space 110 is formed by four conjunctive walls of the main portion 11, and extending along a mating direction of the electrical connector 100. The main portion 11 has a plurality of passageways 112 communicating with the receiving space 110. Four of the passageways 112 are recessed downwardly from an inner surface of a bottom wall of the main portion 11, and the remaining four passageways 112 are recessed upwardly from an inner surface of a top wall of the main portion 11. Each positioning post 13 is a tiny column extending along a horizontal direction.

The extension portion 12 is defined on one side of the main portion 11 along a transverse direction, thus the extension portion 12 together with the main portion 11 forms an L-shaped configuration. The extension portion 12 has a dent 121 depressed downwards from an upper surface thereof The extension portion 12 defines a plurality of slots 122 extending along the mating direction. Front parts of the slots 122 are arranged in the dent 121 and rear parts of the slots 122 are communicated with an exterior in the vertical direction.

The first contacts 2 are used for transmitting high speed signal. Each first contact 2 comprises a resilient contacting portion 21, a tail portion 23, and a connecting portion 22 connecting the contacting portion 21 with the tail portion 23. Tail portions 23 of the first contacts 2 are arranged on a first level along the horizontal direction. The first contacts 2 are received in the corresponding slots 122 of the extension portion 12.

Figure 8:
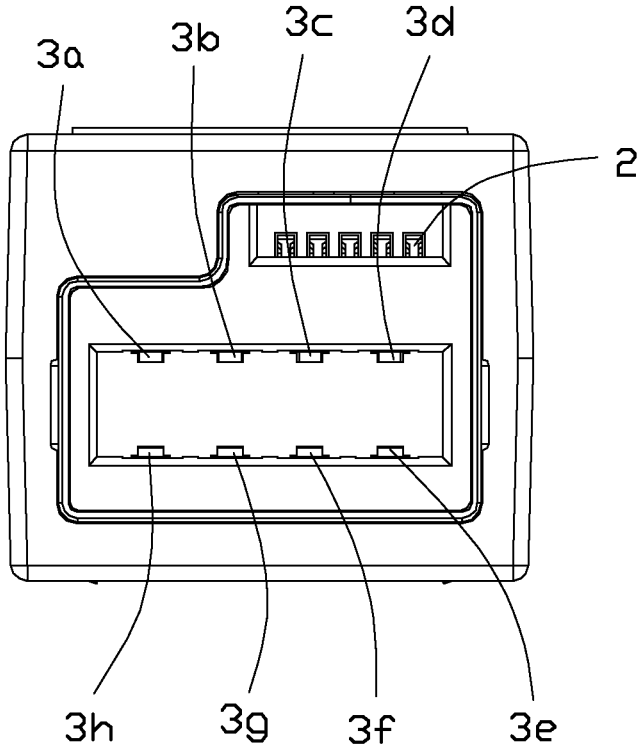
FIG. 8 is a front view of the electrical connector assembly according to the present invention.

Referring to FIGS. 5, 6, and 8, each of the second contacts 3 includes a stiff contacting portion 31, a retaining portion 32 extending backwards from corresponding contacting portion 31, and a tail portion 33 on a back end thereof A bending portion 34 is defined between the retaining portion 32 and the tail portion 33. The second contacts 3 are labeled as 3*a* to 3*h* in sequence, the contacting portions 31 of the second contacts 3 are arranged in two horizontal rows, and tail portions 33 of the second contacts 3 are arranged on a second level along the horizontal direction. The second contacts 3 with upper contacting portions 31 are labeled as 3*a*, 3*b*, 3*c*, 3*d* from left to right, and comprise a power contact 3*a* connecting to a +5V power source, a negative signal contact 3*b*, a positive signal contact 3*c*, and a grounding contact 3*d* (ground return to the power contact 3*a*). The second contacts 3 with lower contacting portions 31 are labeled as 3*e*, 3*f*, 3*g*, 3*h* along a right to left direction, and comprise a DPWR (power provided by device) contact 3*e* connecting a +12V power source, a pair of grounding contacts 3*f*, 3*g* (ground return to DPWR) sharing a common tail portion, and a spare contact 3*h*. The pair of grounding contacts 3*f*, 3*g* are linked together by a conjoining portion 35 connecting two bending portions 34 of the two contacts 3*f*, 3*g*.

Figure 7:
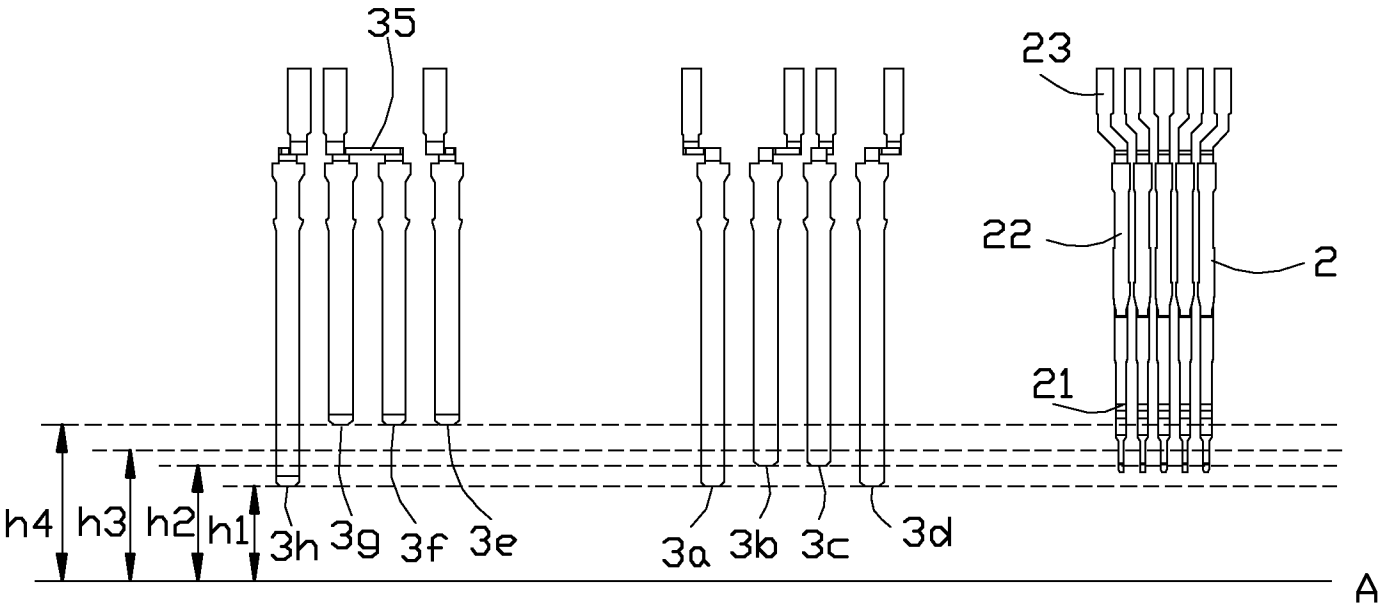
FIG. 7 is a schematic view of the contacts arrangement of the electrical connector assembly according to the present invention.

Referring to FIG. 7, the line A denotes a front end face of the insulative housing 1. When the electrical connector assembly 100 is inserted into a mating connector, the first and second contacts 2, 3 are electrically connected with the mating connector in a certain sequence, and the portion of the first and second contacts 2, 3 contacted by the mating connector initially has a contacting distance to the front end face of the insulative housing 1, and the contacting distances of the contacting portions of the first and second contacts 2, 3 are defined as h. The contacting distance h1 of the power contact 3*a*, the grounding contact 3*d*, and the spare contact 3*h* is the shortest. The contacting distance h2 of the negative contact 3*b* and the positive contact 3*c* is longer than the contacting distance h1. The contacting distance h3 of the first contacts 2 is longer than the contacting distance h2. The contacting distance h4 of the DPWR contact 3*e* and the grounding contacts 3*g*, 3*f* is longer than the contacting distance h3. The shorter the contacting distance of the first and the second contacts 2, 3, the earlier the first and the second contacts 2, 3 connect with the mating connector. Thus, such contacting distance management makes the mating connector sequentially connect with the power contact 3*a*, the grounding contact 3*d* and the spare contact 3*h*, the negative contact 3*b* and the positive contact 3*c*, all the first contacts 2, the DPWR contact 3*e*, the grounding contacts 3*g*, 3*f*

Referring to FIGS. 4-6 , the spacer 4 is assembled to the back end surface of the insulative housing 1 and comprises a front engaging portion 41 and a back supporting portion 42. The engaging portion 41 defines a pair of holes 412 in a front surface thereof for retaining the corresponding positioning posts 13. The supporting portion 42 defines a plurality of grooves 421 on a top surface and a bottom surface thereof to receive corresponding tail portions 23, 33. After the first contacts 2 and the second contacts 3 are assembled to the insulative housing 1, the tail portions 23, 33 are exposed beyond the back end surface of the insulative housing 1 and inserted into the grooves 421 of the spacer 4. The cable 6 is electrically connected with the first and the second contacts 2, 3.

Referring again to FIGS. 4-6, the shielding member 5 is made of metallic material and includes a first shell 51 and a second shell 52 cooperated with each other. The second shell 52 comprises a tube portion 520 enclosing the main portion 11 and a drawer portion 521 extending backwardly from the tube portion 520 for latching with the first shell 51.

The first contacts 2 are assembled in the corresponding slots 122 of the insulative housing 1 and the second contacts 3 are assembled in the corresponding passageways 112 of the insulative housing 1. The contacting portions 31 of the second contacts 3 are divided into two groups on different horizontal levels. The spacer 4 is attached to the back end surface of the insulative housing 1 and the positioning posts 13 of the insulative housing 1 are inserted into the corresponding holes 412 of the spacer 4. Then the insulative housing 1 is assembled to the second shell 52. A cavity 120 is formed by the extension portion 12 of the insulative housing 1 and an upper wall of the second shell 52 and is located above on one side of the receiving space 110. The first contacts 2 are arranged in the cavity 120, and the second contacts 3 are placed in the receiving space 110. The first shell 51 is assembled to the drawer portion 521 of the second shell 52. The inner insulator 7 is molded on rear segments of the first and second shell 51, 52, and enclosed on a front part of the cable 6.

Figure 2:
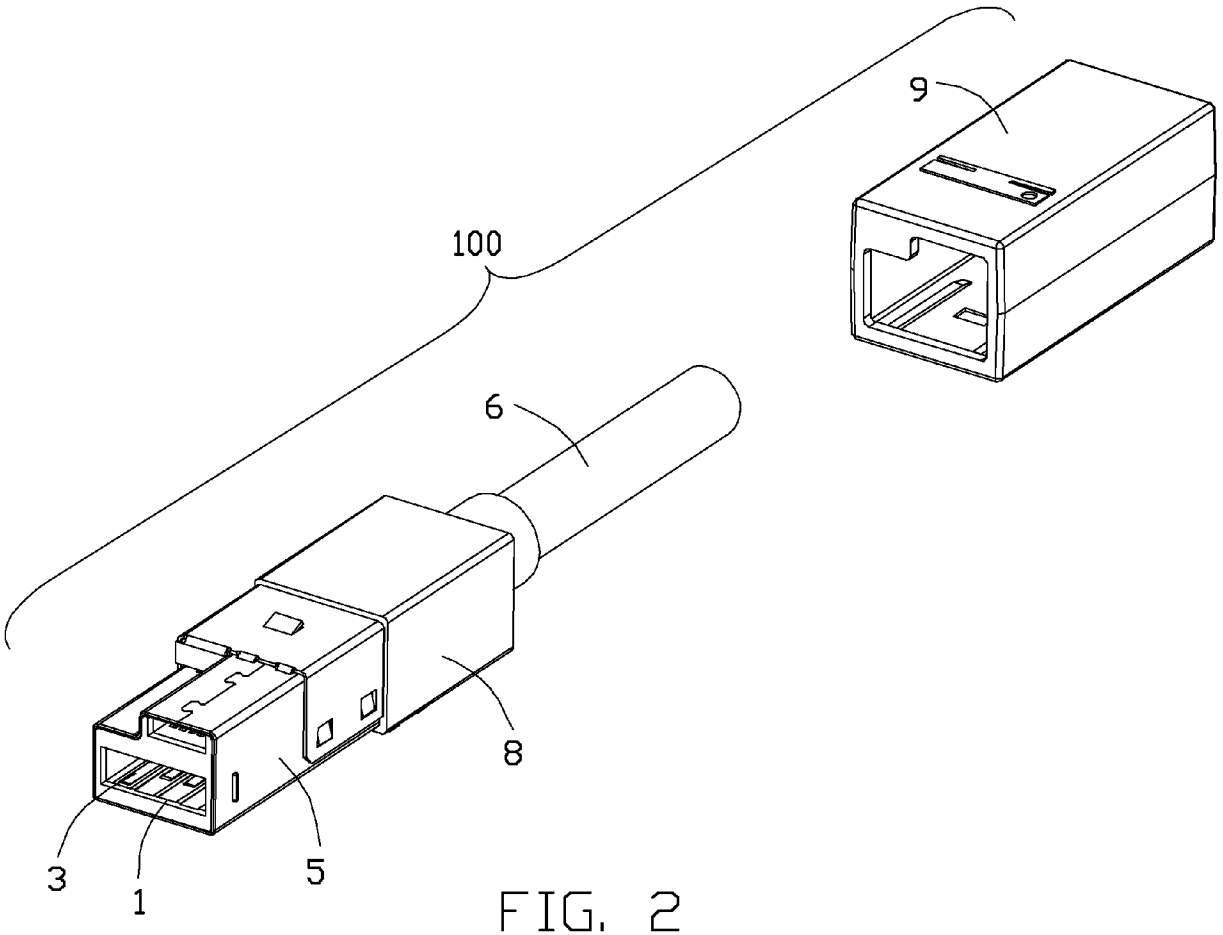
FIG. 2 is a partly exploded view of the electrical connector assembly shown in FIG. 1.
Figure 3:
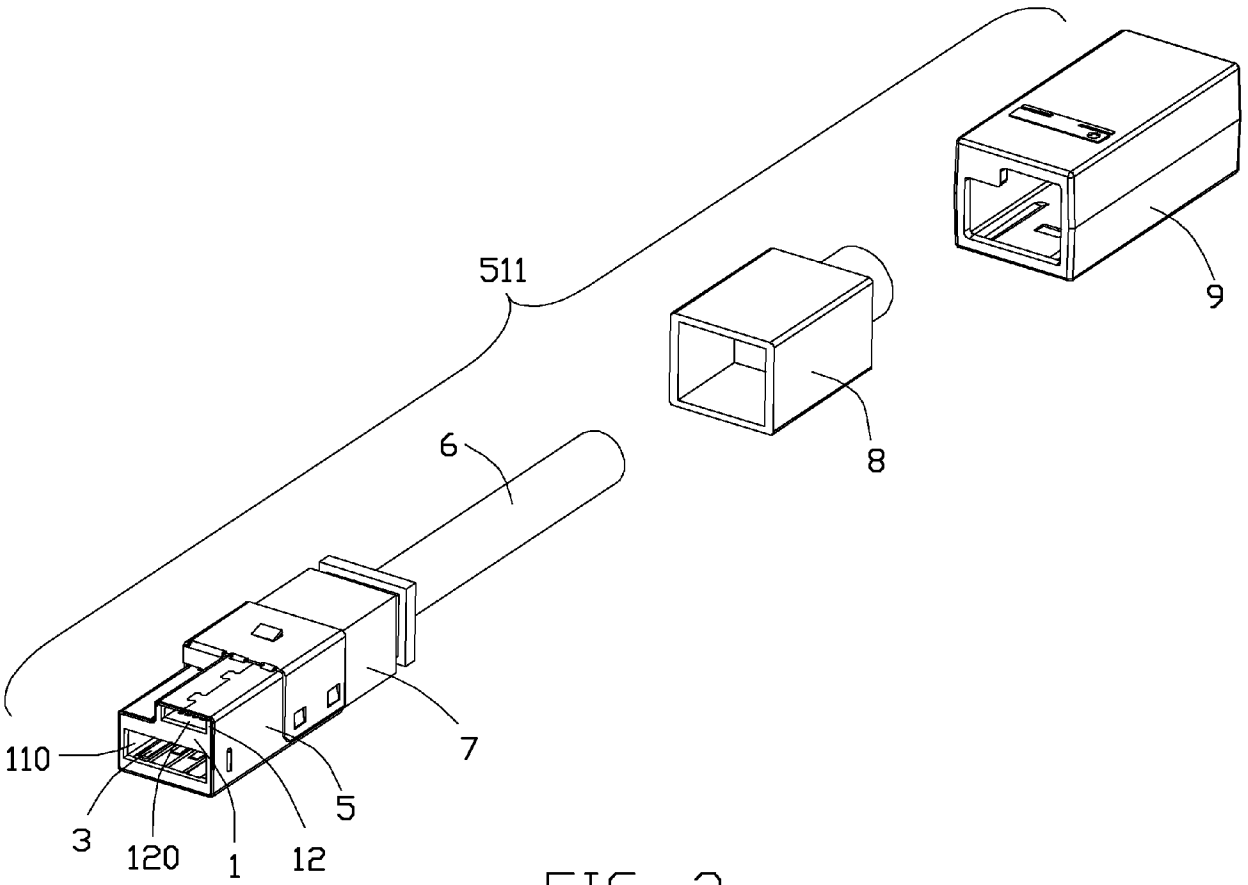
FIG. 3 is a further exploded view of the electrical connector assembly shown in FIG. 2.

Referring to FIGS. 1-2, the front cover 8 is made of insulative material and assembled on the shielding member 5 and the inner insulator 7 along a front to back direction. The back cover 9 is over-molded on the cable 6 and the inner insulator 7, a front section of the back cover 9 is received in the front cover 8, and a back section of the back cover 9 is adjacent to a rear end of the front cover 8 to form a zero clearance fit.

The arrangement of the first and second contacts 2, 3 makes the mating connector connect to the electrical connector assembly 100 in the following order: the spare contact 3*h*, the power contact 3*a* and grounding contact 3*d*, the negative contact 3*b* and positive contact 3*c*, the first contacts 2, the DPWR contact 3*e* and grounding contacts 3*f*, 3*g*. Such order prevents false recognition of the two power supplies by power system circuits, enables the system circuits to have a simple circuit for recognizing different power supplies, and helps simplify related circuits. In practical operation, the different contacting distances of the contacts 2, 3 can be arranged to be contacted in an order so as to facilitate distinct identification of the two power supply contacts.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

an insulative housing defining a receiving space;

a plurality of contacts retained in the insulative housing, the contacts comprising a set of first contacts and a set of second contacts, each of the first and second contacts having a contacting portion and a tail portion, the second contacts received in the receiving space;

a cable electrically connected with the plurality of contacts; and a shielding member enclosing on the insulative housing to form a cavity, the cavity receiving the first contacts; wherein the second contacts are for transmitting high speed signal and comprise a power contact, a negative contact for transmitting negative signal, a positive contact for transmitting positive signal, a first grounding contact return to the power connect, a power provided by device (DPWR) contact, and a second grounding contact return to the DPWR contact;

the contacting portion of each of the set of second contacts is spaced a respective contacting distance from a front end surface of the insulative housing; and the contacting distances of the power contact and the grounding contact are equal to each other and the shortest, the contacting distances of the negative contact and the positive contact are equal to each other and longer than the contacting distance of the power contact, the contacting distances of the first contacts are equal to each other and longer than the contacting distance of the positive contact, and the contacting distances of the DPWR contact and the second grounding contact are equal to each other and longer than the contacting distance of the first contact.

2. The electrical connector assembly according to claim 1, wherein the set of second contacts further comprise a spare contact.

3. The electrical connector assembly according to claim 2, wherein the contacting distance of the spare contact is equal to the contacting distance of the power contact.

4. The electrical connector assembly according to claim 2, wherein the contacting distance of the spare contact is shorter than the contacting distance of the power contact.

5. The electrical connector assembly according to claim 1, wherein the cavity is on one side of the receiving space along a transverse direction.

6. The electrical connector assembly according to claim 1, wherein the contacting portions of the second contacts are arranged in two horizontal rows.

7. The electrical connector assembly according to claim 6, wherein the contacting portions of the power contact, the negative contact, the positive contact, and the first grounding contact are sequentially arranged on an inner top wall of the receiving space, and wherein the contacting portions of the DPWR contact and the second grounding contact are sequentially arranged on an inner bottom wall of the receiving space.

* * * * *